US005102175A

United States Patent [19]

Wu et al.

[11] Patent Number: 5,102,175

[45] Date of Patent: Apr. 7, 1992

[54] DEADBOLT ASSEMBLY FOR CYLINDER LOCK

[75] Inventors: Rong-Faa Wu; Shoei-Jyi Wu, both of Chung-Pu Hsiang, Taiwan

[73] Assignee: Posse Lock Manufacturing Co., Ltd.

[21] Appl. No.: 272,756

[22] Filed: Nov. 17, 1988

[51] Int. Cl.[5] ..... E05C 1/16

[52] U.S. Cl. ..... 292/337; 292/169.21

[58] Field of Search ..... 292/1, 337, DIG. 60, 292/DIG. 74, 169, 169.21, 169.22, 169.23, 169.14

[56] References Cited

U.S. PATENT DOCUMENTS

| | | | |
|---|---|---|---|
| 3,826,177 | 4/1974 | Rivadossi | 292/DIG. 74 X |
| 4,468,059 | 8/1984 | Nelson et al. | 292/DIG. 74 X |
| 4,615,459 | 10/1986 | Couture | 292/DIG. 74 X |
| 4,662,665 | 5/1987 | Lin | 292/DIG. 74 X |
| 4,687,239 | 8/1987 | Lin | 292/DIG. 74 X |
| 4,711,477 | 12/1987 | Fann et al. | 292/DIG. 74 X |
| 4,746,154 | 5/1988 | Fang | 292/337 |
| 4,750,766 | 6/1988 | Shen | 292/DIG. 74 X |
| 4,767,140 | 8/1988 | Lin | 292/DIG. 74 X |
| 4,804,216 | 2/1989 | Marotto | 292/337 |
| 4,850,626 | 7/1989 | Gallego | 292/337 |
| 4,927,195 | 5/1990 | Wu et al. | 292/169.14 |
| 4,927,199 | 5/1990 | Wu et al. | 292/DIG. 60 |

*Primary Examiner*—Eric K. Nicholson

[57] ABSTRACT

A dual backset deadbolt assembly comprises a deadbolt mounted in a deadbolt housing for movement to a locking position or an unlocking position, an extension housing having two parallel side walls which are provided with two cam guide slots located at two different backset distances, a transmission plate means having a front engaging member to connect with the deadbolt and a rear forked portion, the rear forked portion having two rearwardly extending strip members and an elongated opening between the strip members, the strip members having at least one pair of engagement members, the engagement members being formed respectively on the strip members, a single cam member mounted in the extension housing and having at least one spindle slot to be put in an alignment with at least one of the cam guide slots, the cam member having at least one pair of camming members which can engage with the engagement members to actuate the transmission plate.

2 Claims, 15 Drawing Sheets

DEADBOLT ASSEMBLY FOR CYLINDER LOCK

BACKGROUND OF THE INVENTION

The present invention relates to a dual backset deadbolt assembly for a cylinder lock, and particularly to an improvement in a dual backset deadbolt assembly including a single cam member which is arranged to rotate about two parallel axes located at two backset distances.

Deadbolt assemblies which are adjustable between two backset measurements are available for cylinder locks in the art. U.S. Pat. No. 4.615,549 discloses a dual backset latch assembly which includes two intersecting cam members which operate about two separate and parallel axes which are the centers of the two spindle backsets in common industry usage. In this latch construction, the two cam members are respectively mounted on two side plates of the housing of the latch assembly so as to avoid the interaction of the two cam members.

SUMMARY OF THE PRESENT INVENTION

An object of the present invention is to provide an improved dual backset deadbolt assembly which has a single cam member to rotate about two axes located about two spindle backset distances, thereby simplifying the construction of the deadbolt assembly.

According to the present invention, a dual backset deadbolt assembly comprises a deadbolt housing, a deadbolt mounted in the deadbolt housing for movement to a locking position or an unlocking position, an extension housing having two parallel side walls which are provided with two cam guide slots located at two different backset distances, a transmission plate having a front engaging member to connect with the deadbolt and a rear forked portion, the rear forked portion having two rearwardly extending strip members and an elongated opening between the strip members, the opening being aligned with the cam guide slots, the strip members having at least one pair of engagement members, the engagement members being formed respectively on the strip members, a single cam member mounted in the extension housing and having at least one spindle slot to be put in alignment with one of the cam guide slots, the cam member having at least one pair of camming elements which can engage with the engagement members to actuate the transmission plate.

In one aspect of the invention, the transmission plate includes a transmission plate which is provided on each side with two pairs of engagement members on each side of said transmission plate so as to cooperate with each cam member.

In another aspect of the invention, the transmission plate includes two transmission plates each of which is provided on only one side with two pairs of the engagement member, each transmission plate being cooperable with each of the cam members.

In still another aspect of the present invention, the cam member includes two spindle slots each of which is aligned with each cam guide slot. The transmission plate is provided with a recess in each of the strip members and flank faces confining the recess, the flank faces forming two pairs of the engagement members. The camming elements are two pairs of pins which project into the recesses of the strip members.

In still another aspect of the invention, the cam member includes a disc plate and a cam boss projecting from the disc plate, the disc plate being provided with at least one recess and flank faces confining the recess, the flank faces forming two pairs of camming members. Each strip member of the transmission plate is provided with two pins to form the engagement members.

In still another aspect of the invention, the cam member is provided with a single spindle slot which can be moved to be in alignment with either one of the cam guide slots. The cam member includes an annular plate which has an inner edge provided with a tubular flange, the tubular flange having a circular end plate, the circular end plate having a rectangular opening to form the spindle slot, the annular plate being provided with the camming members.

In still another aspect of the invention, an auxiliary mounting plate is provided between the strip members of the transmission plate means, the mounting plate having a front tubular head having a front hole and a tail portion having a rear fastener hole, said mounting plate being movable between a first position in which the tubular head is in alignment with a front one of the cam guide slots, a second position in which the tubular head is in alignment with a rear one of the cam guide slots. The mounting plate extends beyond a rear end of the extension housing when in the second position. The rear fastener hole serves for the attachment of a fastener.

DETAILED DESCRIPTION OF THE PREFERRED EMBODIMENTS

Figure 1:
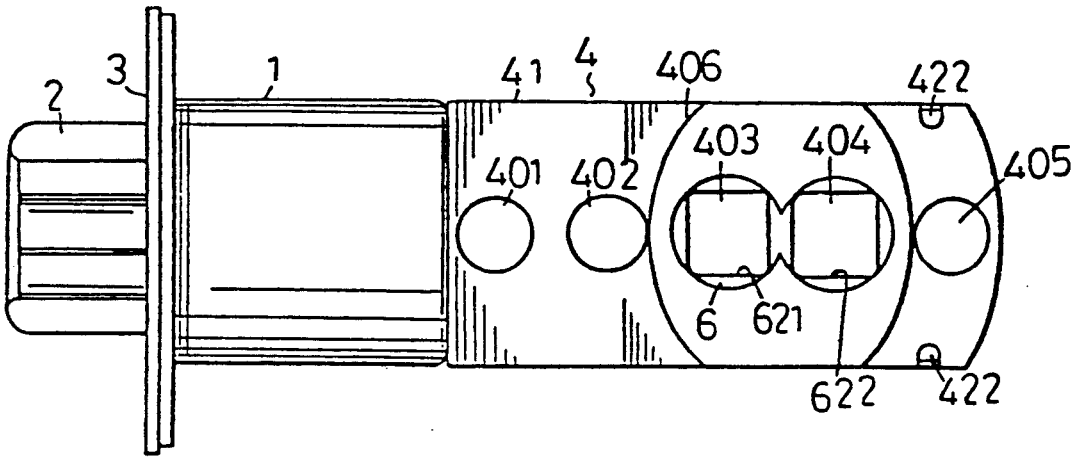
FIGS. 1 to 11 show a first embodiment of the deadbolt assembly of the present invention.

The preferred embodiments of the present invention will be described with reference to the drawings in which like reference numerals are employed to represent like elements.

Figure 2:
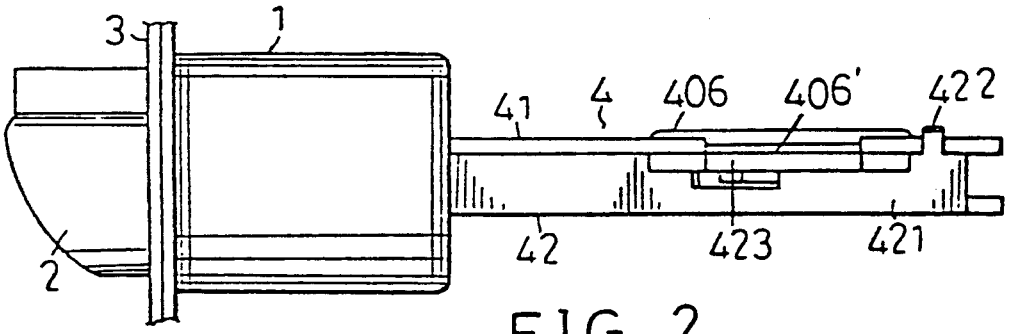
Figure 3:
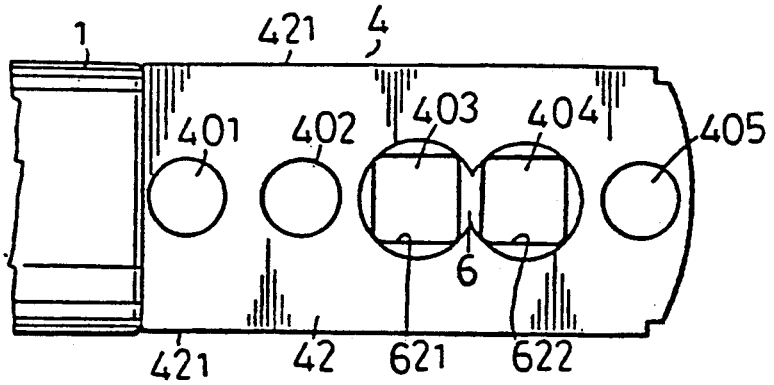

Referring to FIGS. 1, 2 and 3, a first preferred embodiment of the present invention is shown, including a deadbolt housing 1 and a deadbolt 2 provided in the housing 1. The deadbolt housing 1 can be mounted near an edge of a door and has a first mounting plate 3 which is flush with the door edge. The deadbolt 2 is movable between a locking position and an unlocking position. Since the construction of the deadbolt 2 is known, the details thereof are not described hereinunder.

At the rear side of the housing 1 is an extension housing 4 which includes two spaced apart parallel side plates 41 and 42 which are connected to one another so as to confine a chamber. The side plate 42 has upper and lower bent portions 421 which extend towards the side plate 41 and engage with the side plate 41 via tongues 422. An elongated opening 423 is formed in each of the upper and lower bent portions 421. The front ends of the plates 41 and 42 extend into and are positioned in the housing 1. The side plate 41 is provided with a concave portion at the inner side of the side plate 41, which protrudes outwardly at the outer side of the side plate 41 to form a protruding portion 406. Aligned fastener holes 401, 402 405 and aligned cam guide slots 403 and 404 are provided in the side plates 41 and 42. The cam guide slots 403 and 404 are formed in the protruding portion 406 at two backset distances, 60 m/m and 70 m/m.

Figure 4:
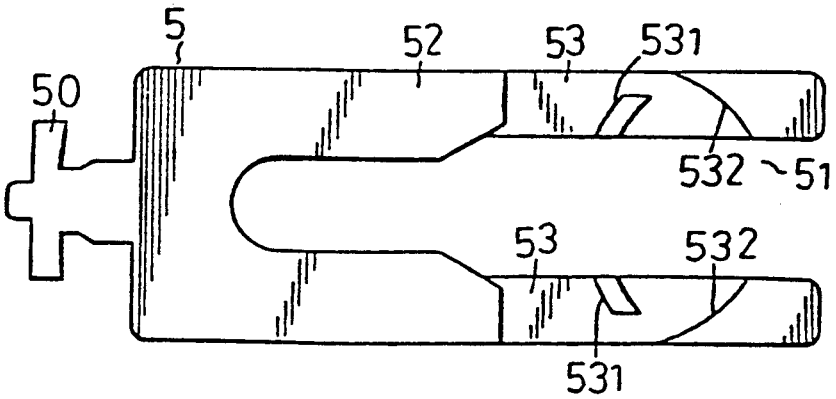
Figure 5:
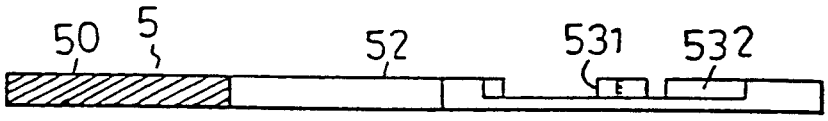
Figure 6:
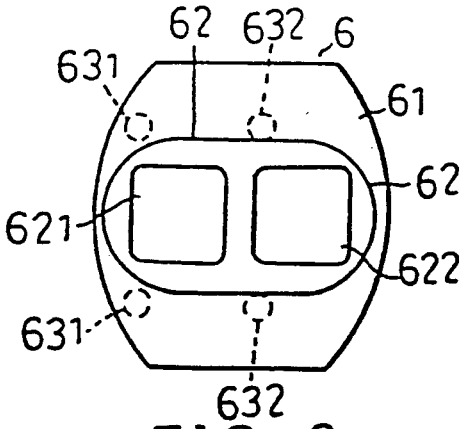
Figure 7:
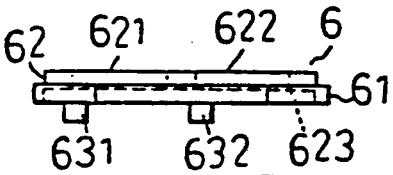

The space confined by the plates 41, 42 accommodates two elements, i.e. a transmission plate 5 shown in FIGS. 4 and 5, and a single cam member shown in FIGS. 6 and 7. The transmission plate 5 has a front engaging member 50 and a rear forked portion which has two spaced apart strip members 52 and an oblong opening 51 between the strip members 52. The opening 51 is aligned with the cam guide slots of the side plates 41, 42. Each strip member 52 is provided with a recess 53, a first engagement flank 531 and a second engagement flank 532. Each first engagement flank 531 is formed at one side of a rib formed in each recess 53.

Referring to FIGS. 6, 7, the cam member 6 includes a substantially elliptical boss 62 at one side thereof, a rectangular front spindle slot 621, a rectangular rear spindle slot 622, a recess 623, a pair of front upper and lower camming pins 631, and a pair of rear upper and lower camming pins 632.

Figure 8:
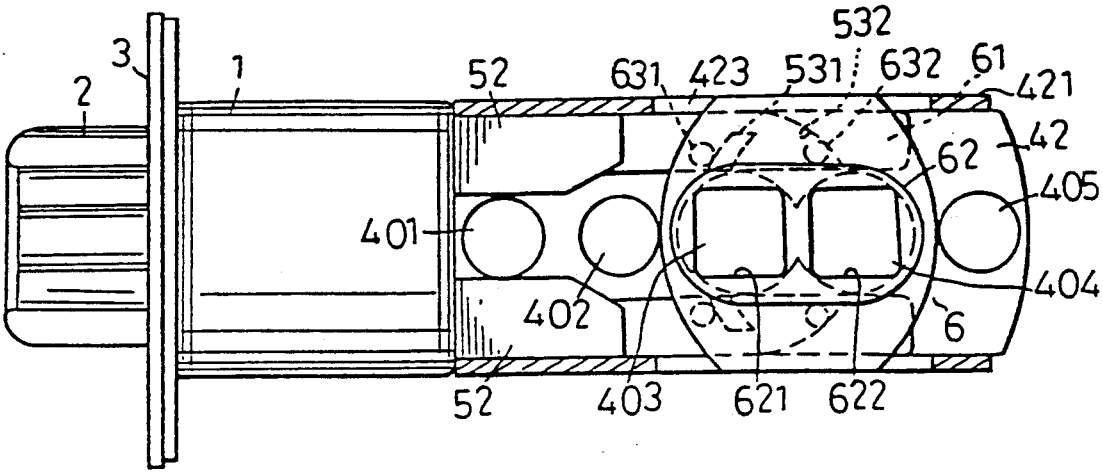
Figure 9:
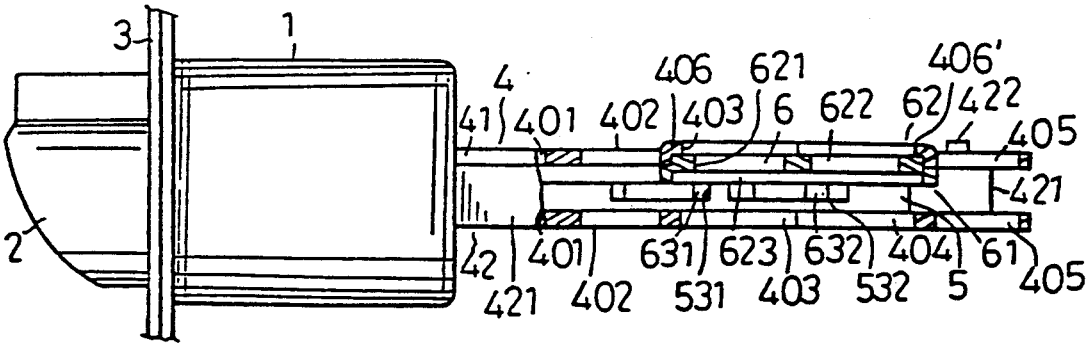

Referring to FIGS. 8 and 9, in assembly, the transmission plate 5 is inserted between the side plates 41 and 42. The front engaging end 50 of the transmission plate 5 is inserted into the housing 1 and is connected to the deadbolt 2. The cam member 6 is placed so as to abut the transmission plate 5 and the side plate 41. The cam boss 62 extends into the concave portion 406' of the side plate 41. The cross section of the concave portion 406' is large enough to permit the cam boss 62 to turn therein about the axis of the cam guide slot 403 or 404. The front camming pins 631 and the camming pins 632 are respectively in engagement with the first engagement face 531 and the second engagement face 532.

Figure 10:
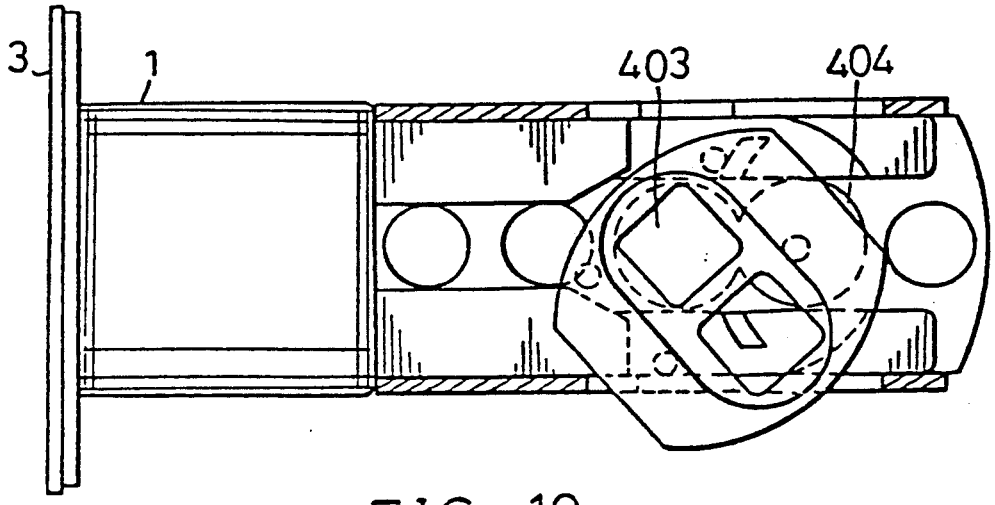
Figure 11:
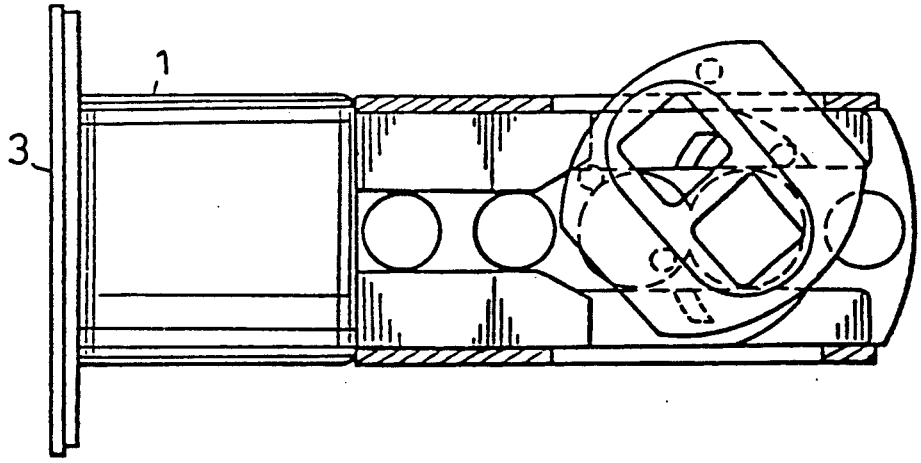

Referring to FIGS. 10 and 11, in operation, the spindle of the lock is inserted into a desired one of said spindle slots 621, 622. When the spindle is inserted into the spindle slot 621 and turned clockwise, the cam 6 turns in a manner as shown in FIG. 10, and the upper camming pin 631 actuates the transmission plate to move rearward. In this case, the lock is secured to the extension housing 4 by means of the securing holes 401 and 405 which receives two fastening bolts of the lock (as the construction of the lock is conventional, the detail thereof is not described herein). When the spindle is inserted into the spindle slot 622 and turned clockwise, the cam turns in a manner as shown in FIG. 11, and the upper rear camming pin 632 moves the transmission plate rearward, thereby placing the deadbolt 2 in an unlocking position. In this case, only the securing hole 402 is used for the attachment of the fastening bolt of the lock. It can be noted that, when the upper camming pins 631 and 632 are in operation, the lower camming pins 631 and 632 do not operate. The lower camming pins 631 and 632 actuate the transmission plate when the cam 6 is turned counter-clockwise.

It can be appreciated that the deadbolt assembly of the first embodiment is of the type that can be combined with two knobs of which only one has a key-operated rotatable spindle at the outside of the door.

Figure 12:
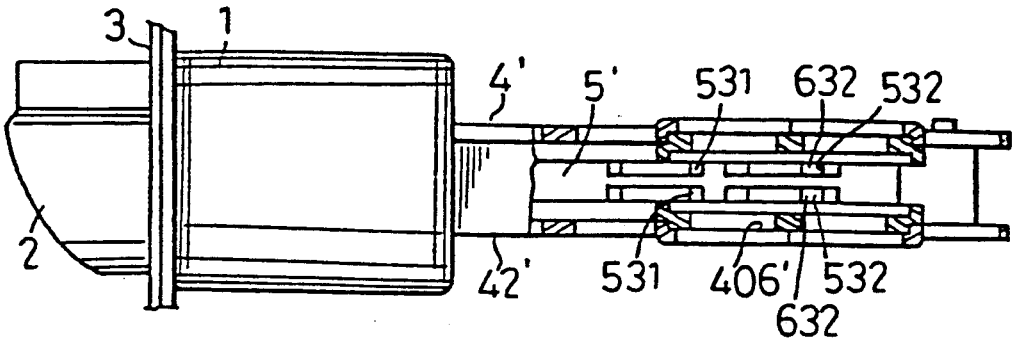
FIG. 12 show a second embodiment of the present invention.
Figure 13:
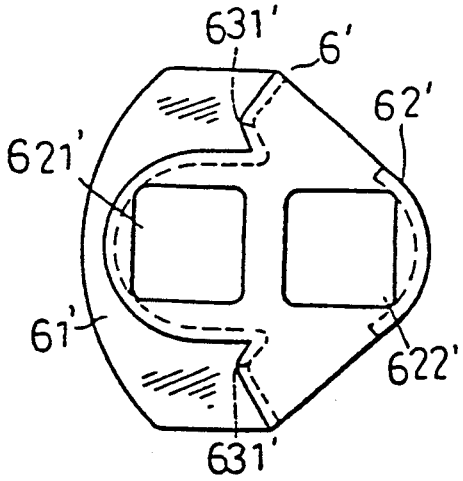
FIGS. 13 to 17 show a third embodiment of the present invention.
Figure 14:
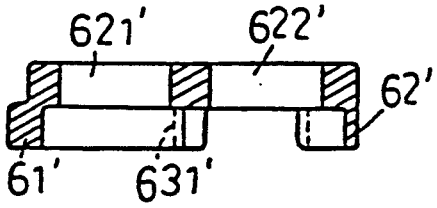
Figure 15:
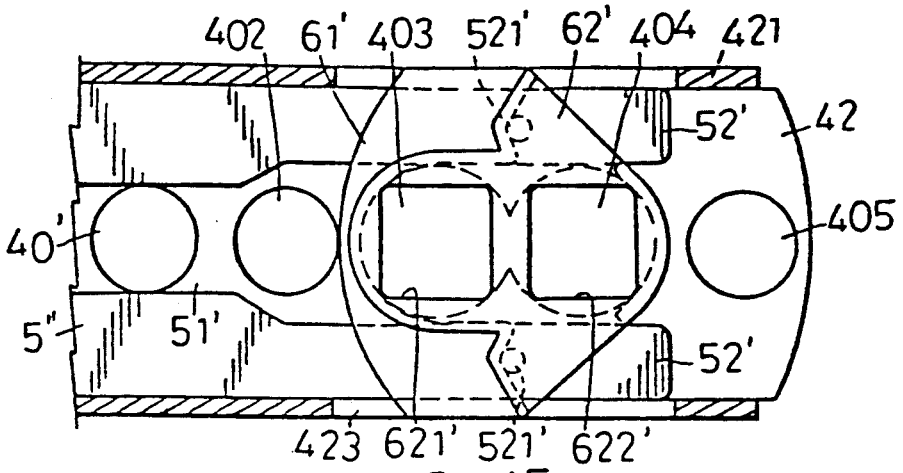
Figure 16:
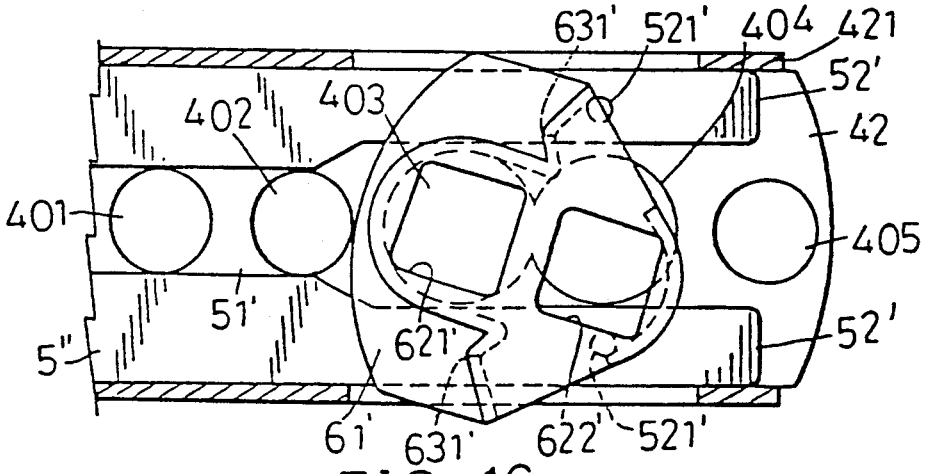
Figure 17:
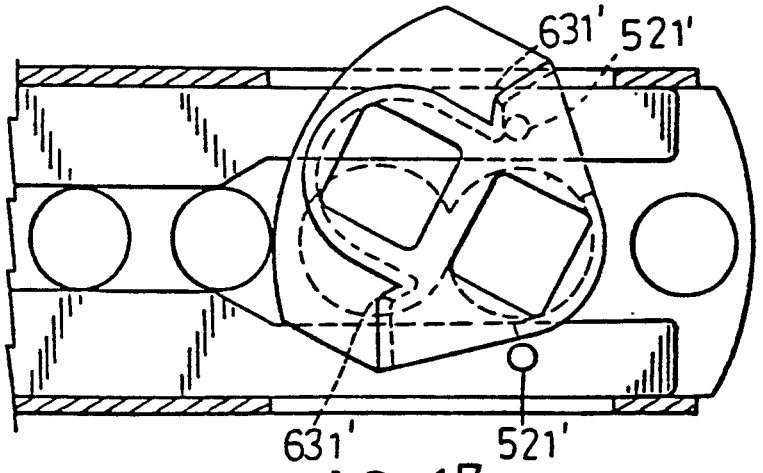
Figure 18:
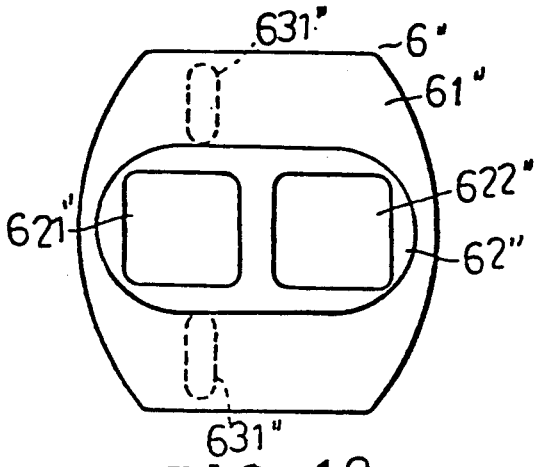
FIGS. 18 to 22 show a fourth embodiment of the present invention.
Figure 19:
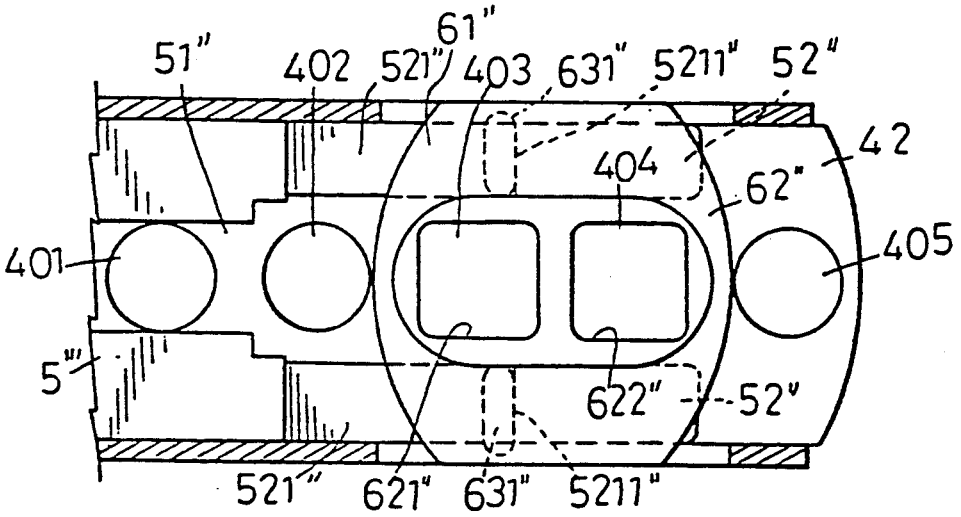
Figure 20:
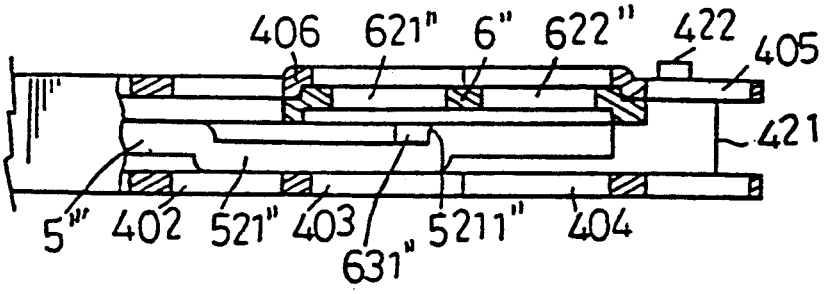
Figure 21:
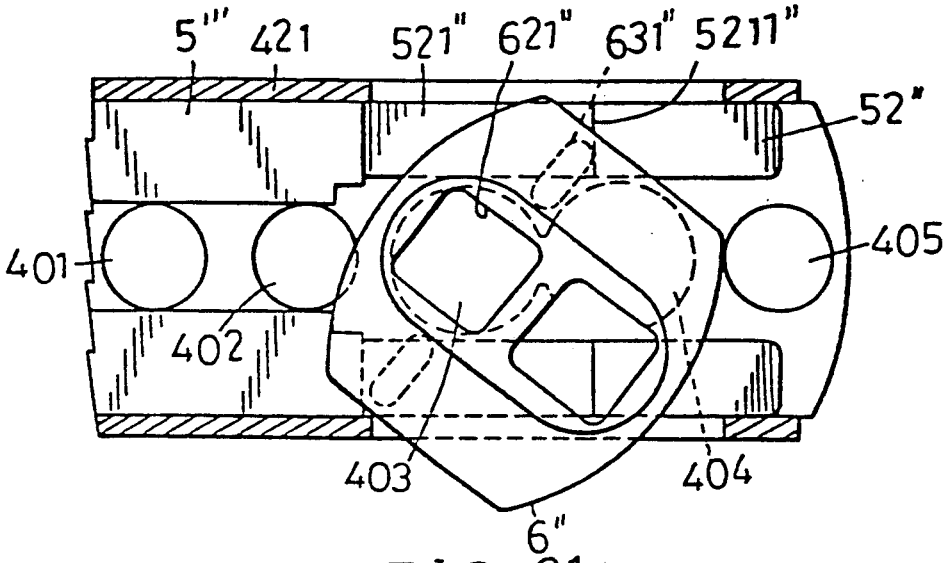
Figure 22:
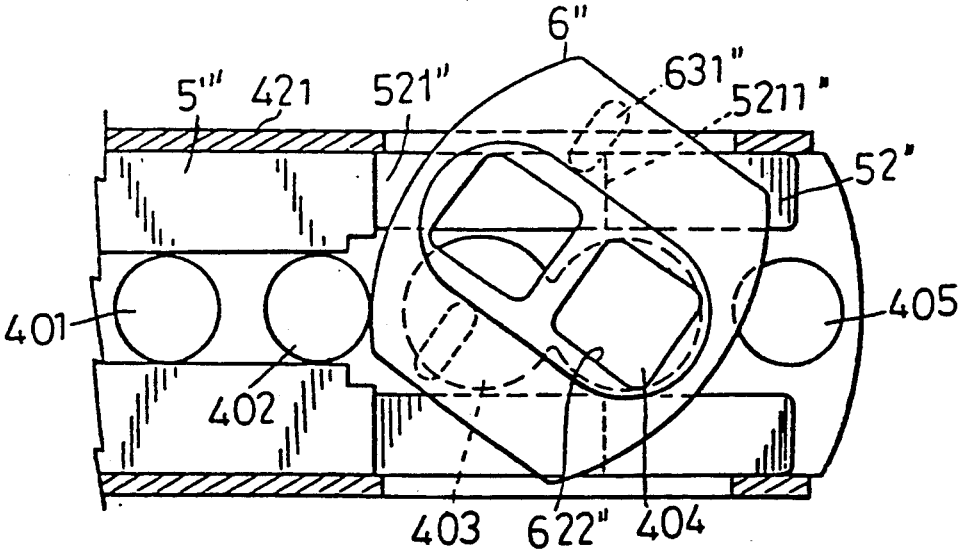
Figure 23:
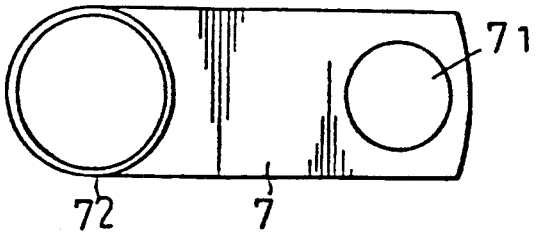
FIGS. 23 to 28 show a fifth embodiment of the present invention.
Figure 24:
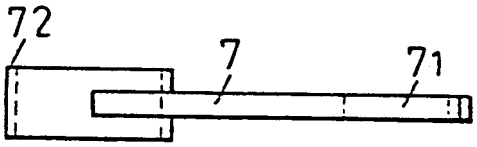

FIG. 12 shows a second embodiment of the deadbolt assembly of the present invention which can be combined with two knobs of which have a key-operated spindle. In this embodiment, the extension housing 4' has a side plate 41 and a side plate 42'. The side plate 42' differs from the side plate 42 in that the side plate 42' is provided with a concave portion 406' as in the side plate 41 so that two cam members 6 can be mounted respectively on the side plates 41 and 42'. The two crank members can cooperate with two spindles of two key-operated knobs, one at the inner side of the door and the other at the outer side of the door. A transmission plate 5' is placed between the cam members 6. The transmission plate 5' is substantially similar to the other transmission plate 5 except that the strip members of the plate 5' are provided with engagement flanks 531, 532 on both sides thereof so as to cooperate with the two cam members 6.

Referring to FIGS. 13 to 17, a third embodiment of the present invention comprises a cam member 6' which includes a disc having two spindle slots 621' and 622', a projecting surface 61' and a projecting surface 62'. The projecting surface 61' has a pair of camming flanks 631' which will engage with pins 521' provided on strip members 52' of a transmission member 5''. Each camming flanks 631' can actuate each pin 521' when the cam 6 is turned about the spindle slot 621' or 622'.

Referring to FIGS. 18 to 22, in a fourth embodiment of the application, a cam member 6'' is employed instead of the cam member 6 or 6'. The cam member 6'' includes an elliptical cam boss 62'', and two rectangular spindle slots 621'', 622'' and a pair of camming members 631''. The transmission plate is provided with a recess 521'' in each strip member 52'' and an engagement flank 5211'' to engage with the camming members 631''.

Figure 25:
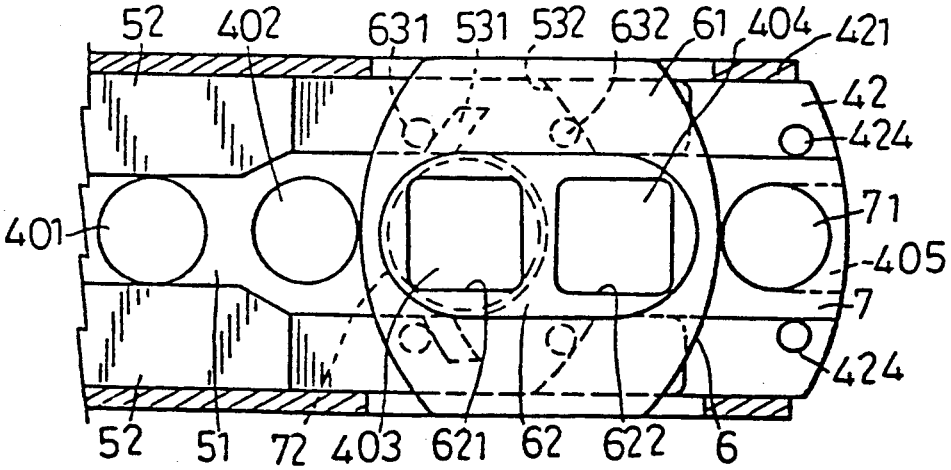
Figure 26:
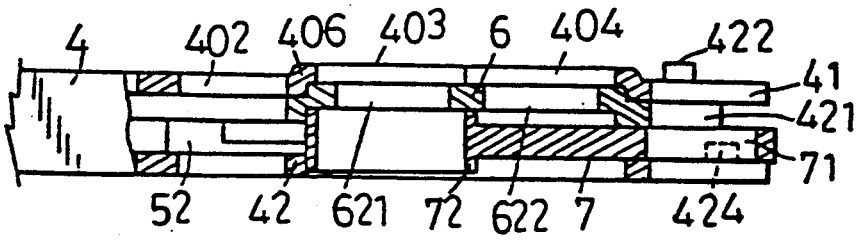
Figure 27:
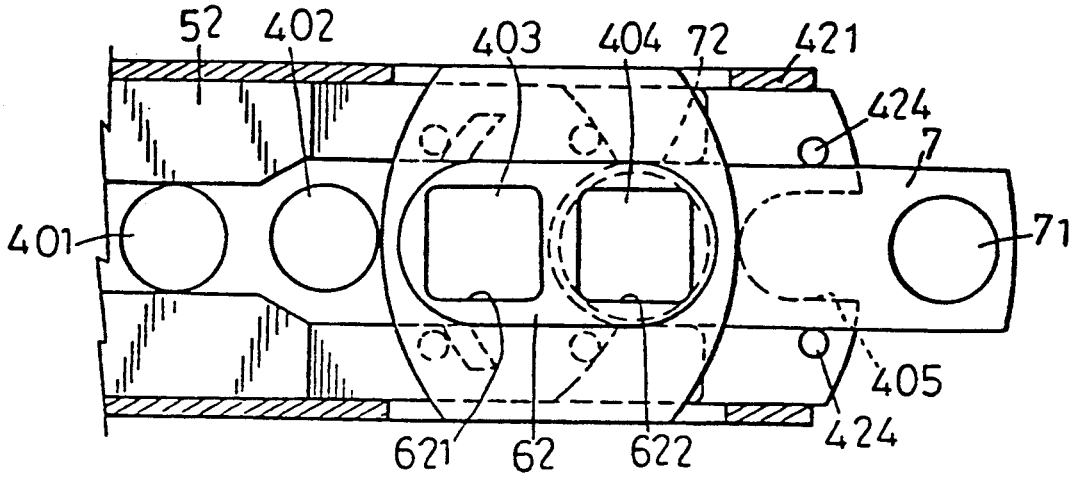
Figure 28:
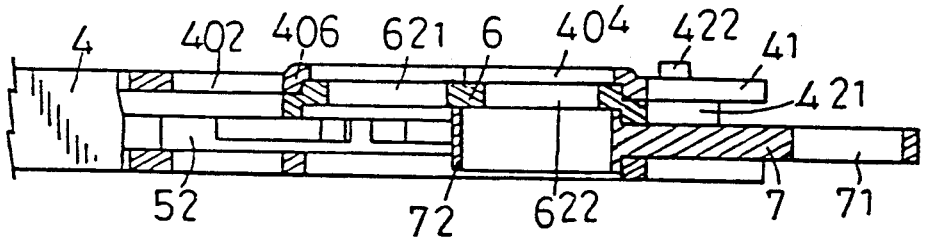

FIGS. 23 to 28 show a fifth embodiment in which the deadbolt assembly of the first embodiment employs an auxiliary mounting plate 7 by which a cylinder lock can be secured to the extension housing of the deadbolt assembly more firmly than in the other embodiments. The auxiliary mounting plate 7 is rectangular and provided with a rear fastener hole 71 near a tail portion thereof. At a front end of the mounting plate 7 is formed a tubular head 72. The auxiliary mounting plate 7 is placed between the two strip members 52 of the transmission plate 5 and the tail portion of the mounting plate 7 is positioned between the positioning studs 424 of the side plate 42. The mounting plate 7 is movable both forward and rearward. As shown in FIGS. 25 and 26, when one end of the tubular member 72 of the mounting plate 7 is extended into the cam guide slot 403 of the plate 42 and the other end of the tubular member 72 is extended into the recess 623 of the cam member 6 (see FIG. 7), the hole 71 of the mounting plate 7 is in alignment with the fastener holes 405 of the side plates 41 and 42. As shown in FIG. 27 and 28, when one end of the tubular member 72 is extended into the cam guide slot 404 and the other end thereof is extended into the recess 623 of the cam member 6, the hole 71 of the mounting plate 7 is at location beyond the end of the extension housing 4. In this case, the securing hole 402 of the side plates and the hole 71 can be used for the attachment of the fastening bolts of the lock.

Figure 29:
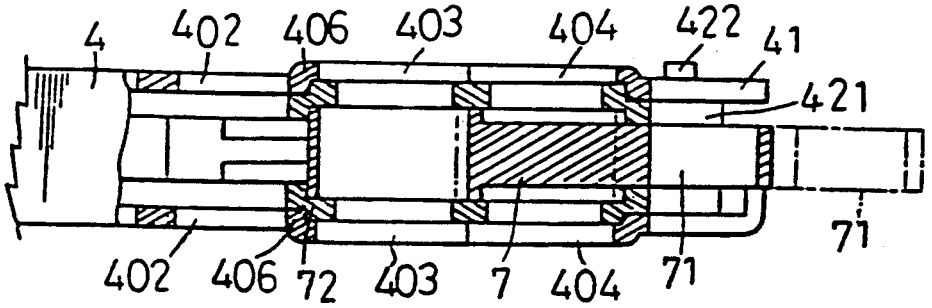
FIG. 29 shows a modified form of the fifth embodiment.
Figure 30:
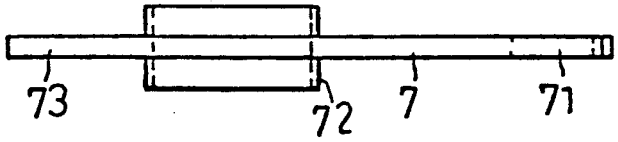
FIG. 30 shows a modified form of the mounting plate of the fifth embodiment.
Figure 31:
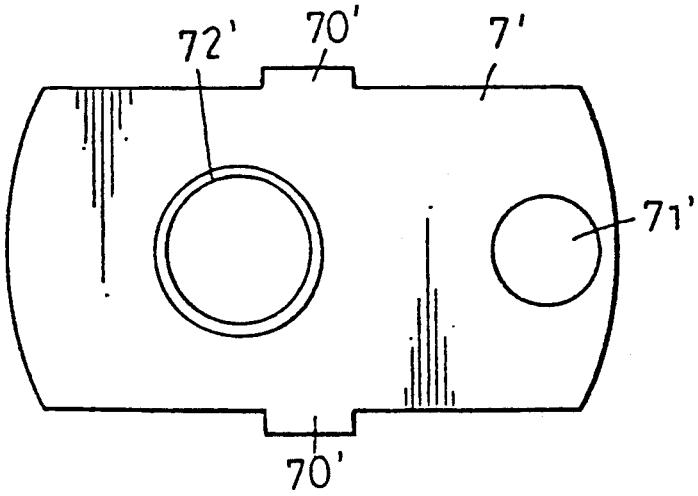
FIGS. 31 and 32 show another modified form of the mounting plate of the fifth embodiment.
Figure 32:
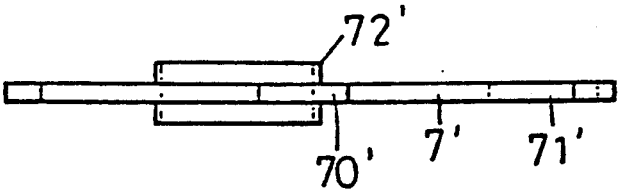
Figure 33:
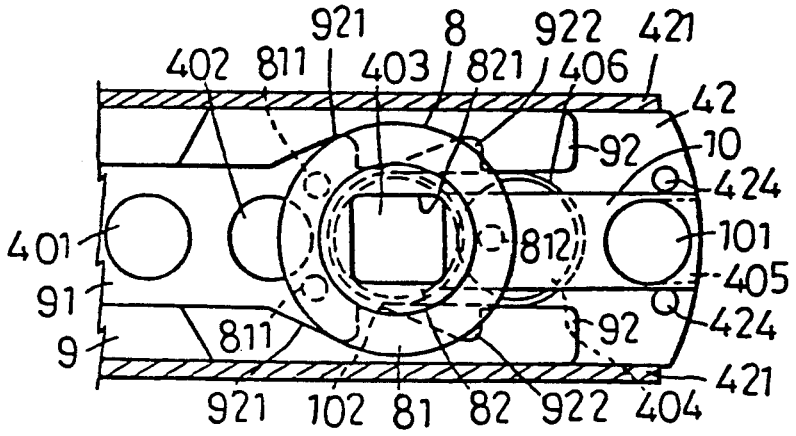
FIGS. 33 to 37 show a sixth embodiment of the present invention.
Figure 34:
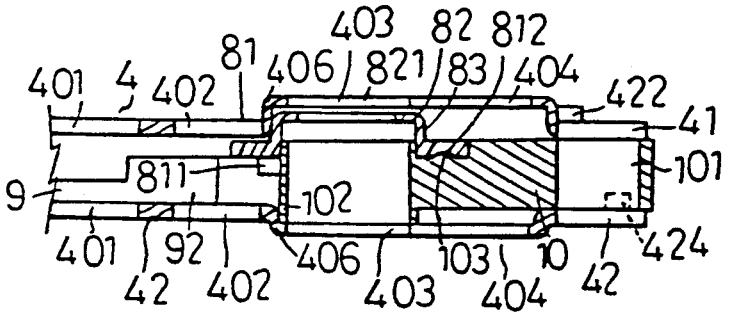

FIG. 29 shows that the mounting plate 7 can also be used in the deadbolt assembly of FIG. 12. FIG. 30 shows an alternative mounting plate 7 which has a front extension portion 73 that can be extended into the deadbolt housing 1. FIGS. 31 and 32 show still another mounting plate 7' which differs from the mounting plate 7' in that the area of the plate 7' is enlarged so that the plate will extend out of the upper and lower bent portions 421 of the side plate 42 through appropriate slots, thereby increasing the stability of the mounting plate 7' in the extension housing 4.

Referring to FIGS. 33 to 38, in the sixth embodiment of the present invention, the deadbolt assembly includes a cam member 8, a transmission plate 9 and an auxiliary mounting plate 10 instead of the cam member 6, the transmission plate 5 and the auxiliary mounting plate 7. The cam member 8 includes an annular plate 81 with an inner tubular flange 83 and a central circular end plate 82. The circular end plate is provided with a rectangular spindle slot 821, and the annular plate 81 is provided with a pair of pins 811 and a positioning recess 812.

The transmission plate 9 is substantially similar to the transmission plate 5, including two strip members 92, the oblong opening 91, a pair of notches 921 and another pair of notches 922. The cam member 8 can be positioned either at a position in which the spindle slot 821 is aligned with the cam guide slot 403 or a position in which the spindle slot 821 is aligned with the cam guide slot 404. The auxiliary mounting plate 10 has a tubular head 102, a rear fastener hole 101, and a stud 103. The stud 103 is engaged with the recess 812 of the cam member 8 so that the mounting plate 10 can move together with the cam member when changing the position thereof. The rear fastener hole 101 of the mounting plate is used for the attachment of a fastener.

Figure 35:
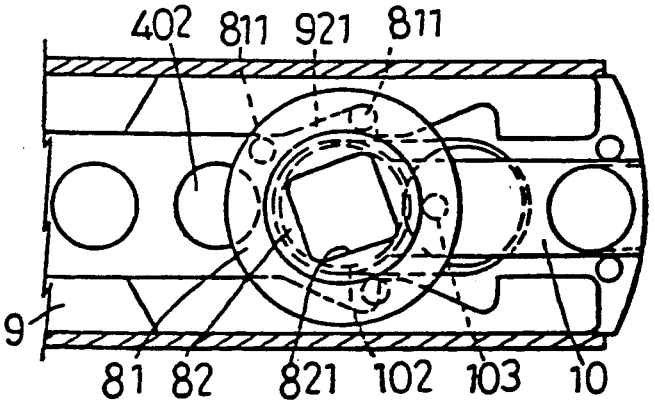
Figure 36:
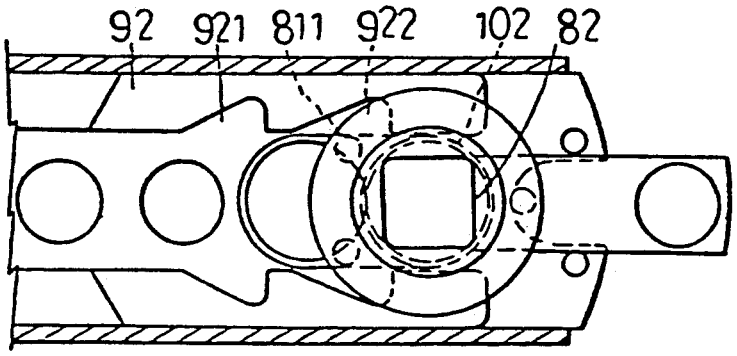
Figure 37:
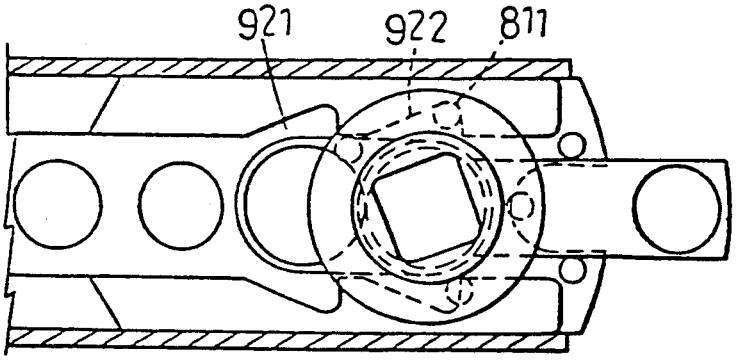

As shown in FIG. 35, when the cam member 8 is at the front position, the camming pins 811 engage with the notches 921. As shown in FIGS. 36 and 37, when the cam member 8 is at the rear position, the camming pins 811 engage with the notches 922.

Figure 38:
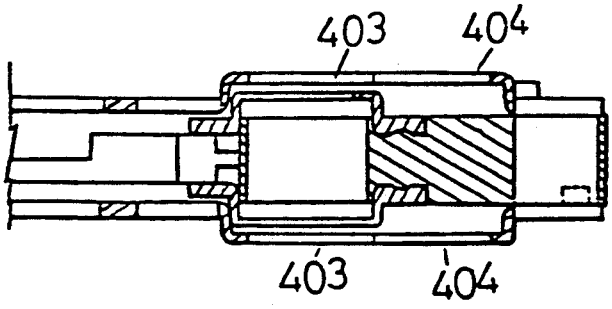
FIG. 38 shows a seventh embodiment of the present invention.
Figure 39:
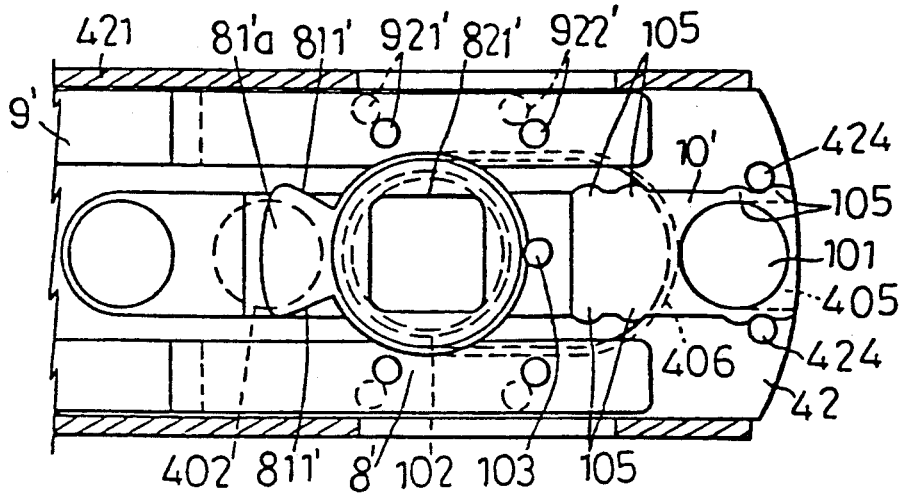
FIGS. 39 to 43 show an eighth embodiment of the present invention.
Figure 40:
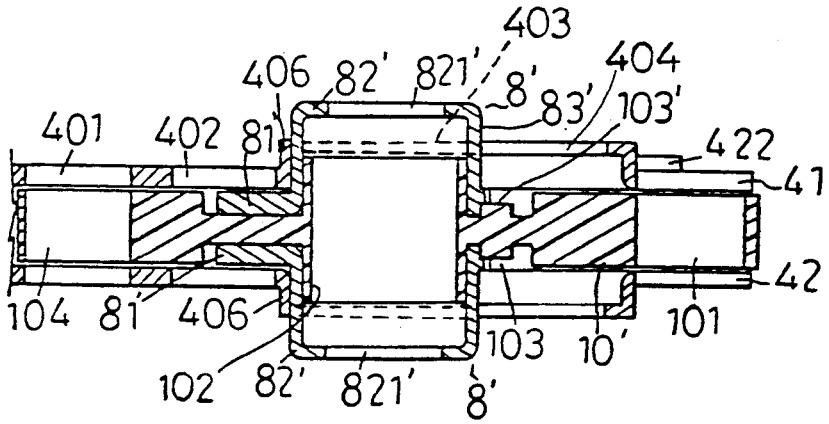

FIG. 38 shows a seventh embodiment in which the sixth embodiment is modified in such a manner that the deadbolt assembly has two cam members 8 mounted on two side plates of the extension housing.

Figure 41:
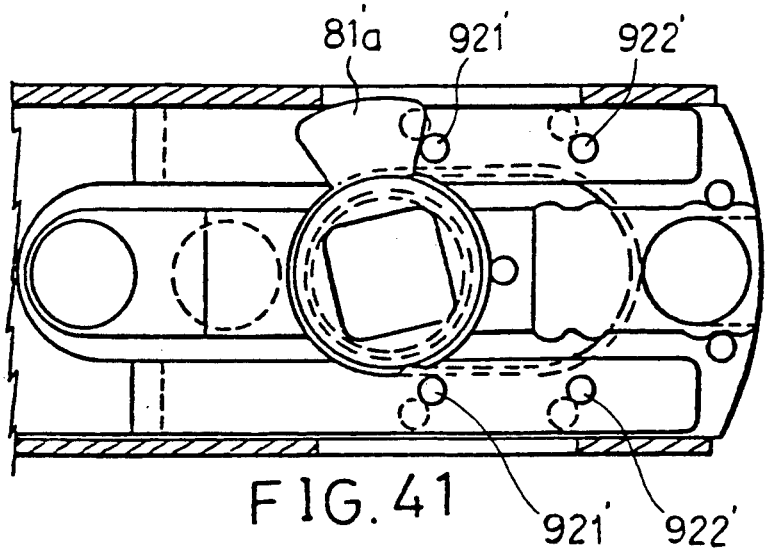
Figure 42:
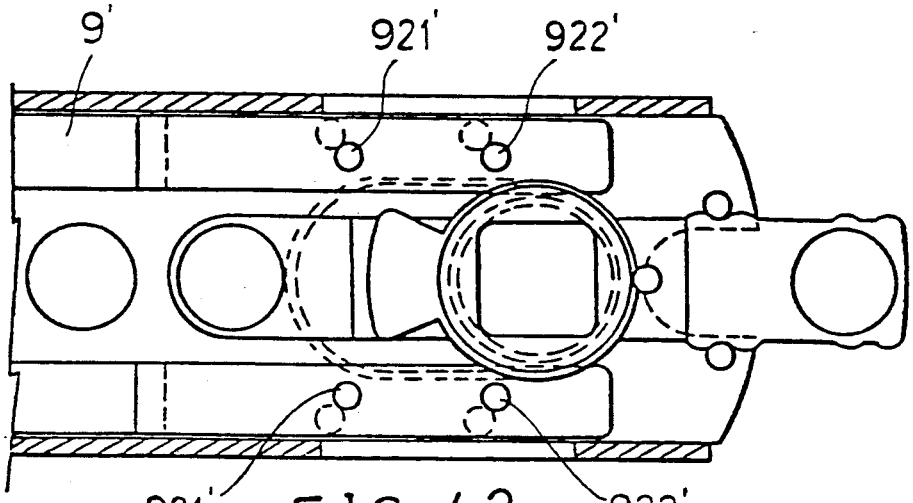
Figure 43:
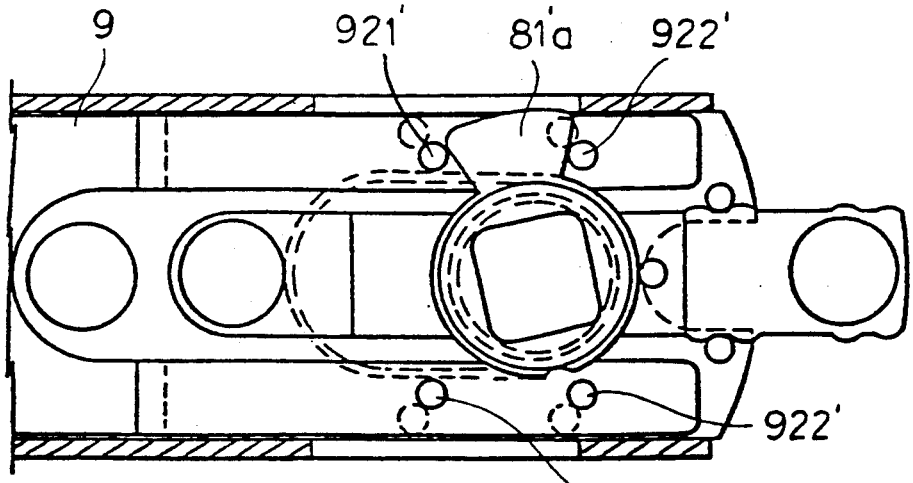

FIGS. 39 to 43 show an 8th embodiment in which the seventh embodiment is altered in such a manner that it includes two cam members 8' and a transmission plate 9'. The transmission plate 9' differs from the other transmission plate 9 in that it is provided with pins 921', 922' instead of the notches 921, 922. The cam member 8' differs from the other cam member 8 in that it has of an annular flange 81', a tab 81' a truncated sector shape, instead of the annular plate 81. The edges 811' of the tab 81' serve as camming members instead of the pins 811. The tubular members 83' of the cam member 8' are arranged in such a manner that they can extend out of the cam guide slots. Circular end plates 82' of tubular members 83' are provided with spindle slots 821'. The mounting plate 10' differs from the mounting plate 10 in that the mounting plate 10' is provided with retractable studs 105 to engage releaseably with the studs 424 of the side plate 42. Numerals 101', 102' and 103' represent respectively the fastener hole, the tubular member and the stud of the auxiliary mounting plate 10'. The operations of the 8th embodiment are similar to that of the seventh embodiment and are shown in FIGS. 41 to 43.

With the invention thus explained, it is apparent that numerous modifications and variation can be made without departing from the scope of the invention. It is therefore intended that the invention only be limited as indicated in the appended claims.

What I claim is:

1. A dual backset deadbolt assembly for inner and outer locks of a door, each having a deadbolt operating spindle, comprising:

a deadbolt (2) mounted in said deadbolt housing for moving to a locking position or an unlocking position;

an extension housing (4) having two parallel side plates (41, 42) each of which as two cam guide slots (403, 404) located at two different backset distances;

two cam members (8') each of which is selectively mounted to said two cam guide slots (403, 40) in each of said side plates (41, 42) respectively, each of said cam members (8') having a tubular member (83') which is fitted in and passes through said respective cam guide slot (403 or 404), and which has an outer end and an inner end, a circular end plate (82') which is formed at said outer end of said tubular member (83') and which has a spindle slot (821'), and a radial tab (81') formed at said inner end of said tubular member, said tab (81') being formed with at least one pair of camming elements, a transmission plate (9') movably provided between said two cam members and having a front engaging member to connect with said deadbolt (2) and a rear forked portion, said rear forked portion having two rearwardly extending strip members and an elongated opening between said strip members, said opening being aligned with said cam guide slots, each of said strip members having engagement pins (921', 922') on two sides thereof to be cammed by said camming elements of said cam members, and an auxiliary mounting plate (10') provided longitudinally in said elongated opening of said transmission plate and between said two cam members, said auxiliary mounting plate having a tubular member (102) which is formed integrally therewith and has two ends extending into said cam members, said tubular member of said auxiliary mounting plate keeping said cam members and said transmission plates in a proper movable position.

2. A dual backset deadbolt assembly as claimed in claim 1, wherein said tab (81') has the shape of a truncated sector having two radial camming edges (811').

* * * * *

UNITED STATES PATENT AND TRADEMARK OFFICE

CERTIFICATE OF CORRECTION

PATENT NO. : 5,102,175

DATED : April 7, 1992

INVENTOR(S) : Rong-Fan WU et al.

It is certified that error appears in the above-identified patent and that said Letters Patent is hereby corrected as shown below:

On the Title Page, item [73], the correct Assignee is

--Tong Lung Metal Industry Co., Ltd.--.

Signed and Sealed this

Seventeenth Day of August, 1993

*Attest:*

*Attesting Officer*

BRUCE LEHMAN

*Commissioner of Patents and Trademarks*